United States Patent [19]

Robards

[11] 3,970,287

[45] July 20, 1976

[54] GUIDE BLOCK FOR A CABLE

[75] Inventor: David S. Robards, Cincinnati, Ohio

[73] Assignee: Hi-Lo Powered Stirrups, Inc., Cincinnati, Ohio

[22] Filed: Jan. 28, 1975

[21] Appl. No.: 544,856

[52] U.S. Cl. ..... 254/190 R; 182/10

[51] Int. Cl.[2] ..... B66D 1/36

[58] Field of Search ..... 214/190 R, 193, 194, 214/134.3, 134.4; 114/181; 294/87.26, 87.28, 91, 90, 103 R, 29, 31 A; 254/135 R, 175.7; 182/150, 10

[56] References Cited

UNITED STATES PATENTS

| | | | |
|---|---|---|---|
| 1,622,537 | 3/1927 | Neilson | 294/91 |
| 1,768,450 | 6/1930 | Hoffman | 294/91 |
| 1,804,074 | 5/1931 | Adams | 294/91 |
| 1,955,942 | 5/1933 | Bush | 254/190 R |
| 2,168,463 | 8/1939 | Wansch | 254/190 R |
| 2,650,066 | 8/1953 | Troter | 254/190 R |
| 2,946,559 | 7/1960 | Pickett | 254/190 R |
| 3,718,108 | 2/1973 | Janssen | 254/190 R |
| 3,806,094 | 4/1974 | Harken | 254/194 |

*Primary Examiner*—Albert J. Makay
*Assistant Examiner*—Kenneth Noland
*Attorney, Agent, or Firm*—Wood, Herron & Evans

[57] ABSTRACT

A guide block of the open breach type particularly adapted for use in connection with a vertically disposed cable. The guide block includes two U-shaped hand plates fixed in parallelism relative one to the other, the plates being separated one from the other a distance at least slightly greater than the diameter of the cable. Each hand plate is provided with a hole centrally thereof, and a slot extending from that hole to one edge thereof. The hole diameters are each substantially greater than the cable diameter, and the slot widths are each only slightly greater than the cable diameter. The hand plates are oriented relative one to the other so that the holes are concentrically disposed, and so that the slots face in opposite directions one from the other. The hand plates are fixed relative one to the other so as to define a mouth which provides access to the two slots for a cable.

6 Claims, 5 Drawing Figures

GUIDE BLOCK FOR A CABLE

This invention relates to cable guides. More particularly, this invention relates to a specific guide block structure for a cable.

Swing stage or free hanging scaffolds are customarily used in construction, repair and painting work for raising and lowering workers along the face of a building or the like. More recently, such swing stage scaffolds have found wide use in connection with washing windows of high-rise or skyscraper type buildings. In such instances a scaffold may be supported between two hoisting mechanisms, i.e., a hoisting mechanism is positioned at each end of the scaffold, and the mechanisms operated in tandem to raise and lower the scaffold. Also, during construction of a building elevator cages are customarily used for moving men and materials from ground level to upper floors of that building. A single hoisting mechanism is often used for raising and lowering such elevator cages.

In the case of swing stage scaffolds and/or elevator cages adapted for use with such hoisting mechanisms, the hoisting mechanism may be of the type having a power driven sheave or pulley system through which a freely hanging, single strand of cable is threaded. This cable is suspended from an overhead support. When the mechanism's sheave or pulley system is power driven in one direction the mechanism climbs the cable, and when the mechanism's sheave system is driven in the opposite direction the mechanism descends the cable.

Power driven hoisting mechanisms of the type particularly adapted for ascending and descending a freely hanging, single strand of cable are well known to the prior art. Such hoisting mechanisms are shown, for example, in Mauldin U.S. Pat. No. 3,794,298; Mauldin U.S. Pat. No. 3,276,745; Allenbaugh U.S. Pat. No. 2,938,707, and Allenbaugh U.S. Pat. No. 2,662,734. These hoisting mechanisms are all particularly adapted for use with swing stage scaffolds and elevator cages of the type described above. The hoisting mechanism structures taught by these patents each incorporate an open breach type of power driven sheave or pulley system so that that system can be easily threaded or unthreaded with the single strand of cable when the hoisting mechanism is resting on the ground. Such an open breach type of sheave system is desirable because the cable can be threaded into the power driven sheave system at any point intermediate its ends, i.e., the cable need not be threaded into the sheave system from one end or the other as if threading a needle.

In addition to the power driven sheave system, each such swing stage scaffold or elevator cage is usually provided with a safety lock through which the freely hanging cable passes. The safety lock functions to quickly grab onto the cable if the scaffold or cage should start to fall relative to ground level due to a malfunction in the sheave system. That is, and immediately upon a malfunction of the sheave system that would normally allow rapid descent of the scaffold or cage but for the safety lock, the safety lock functions to keep that scaffold or cage from falling to ground level, thereby preventing an accident. A particularly useful safety lock for use with sheave systems as disclosed in the patents cited above is illustrated in Allenbaugh U.S. Pat. No. 2,931,466.

Cable guides are required in combination with the safety lock, and in combination with the power driven sheave system, to properly guide the cable into and out of those devices. That is, cable guides are necessary to maintain proper alignment of the cable with the operating parts of the safety lock, and with the operating parts of the sheave system, as the scaffold or cage is caused to climb or descend the freely hanging cable by the power driven sheave system. There are, of course, cable guides known to the prior art which are capable of providing this function. However, in light of the fact that a very desirable feature of the sheave systems disclosed in the patents cited above, and a very desirable feature of the cable lock disclosed in the patent cited above, is the open breach nature of those devices, it is also quite desirable that such guides be of the open breach type. In other words, it is highly desirable that the cable guide be structured so that the cable can be functionally associating with the guide at any point intermediate its ends. That is, it is highly desirable that such cable guides be structured so that the cable need not be threaded through the guide from one end to the other as if threading a needle.

Therefore, it has been one objective of this invention to provide a novel cable guide block structure.

It has been another objective of this invention to provide a novel cable guide block structure of the open breach type that is useful with a device, e.g., a swing stage scaffold or elevator cage, adapted to climb up and down a vertially disposed strand of cable.

It has been a further objective of this invention to provide a novel cable guide block structure of the open breach type that is movable between a cable-guiding position and a cable-threading position, thereby permitting a strand of cable to be operationally disposed therewith even if that strand is taut.

In accord with these objectives, the cable block guide structure of this invention is of the open breach type, and is particularly adapted for use in connection with a vertically disposed cable. The guide block includes two U-shaped hand plates fixed in parallelism relative one to the other, the plates being separated one from the other a distance at least slightly greater than the diameter of the cable. Each plate is provided with a hole centrally thereof, and a slot extending from that hole to one edge thereof. Preferably, the hole diameters are each substantially greater than the cable diameter, and the slot widths are each only slightly greater than the cable diameter. The hand plates are oriented relative one to the other so that the holes are concentrically disposed, and so that the slots face in opposite directions one from the other. The hand plates are fixed relative one to the other so as to define a mouth which provides access to the two slots for a cable.

A cable may be operatively associated with the guide block by initially orienting a cable section parallel to the plates and inserting same into the block's mouth, and thereafter moving the cable through the slots into coaxial alignment with the plates' holes.

Other objectives and advantages of this invention will be more apparent from the following detailed description taken in conjunction with the drawings in which.

Figure 1:
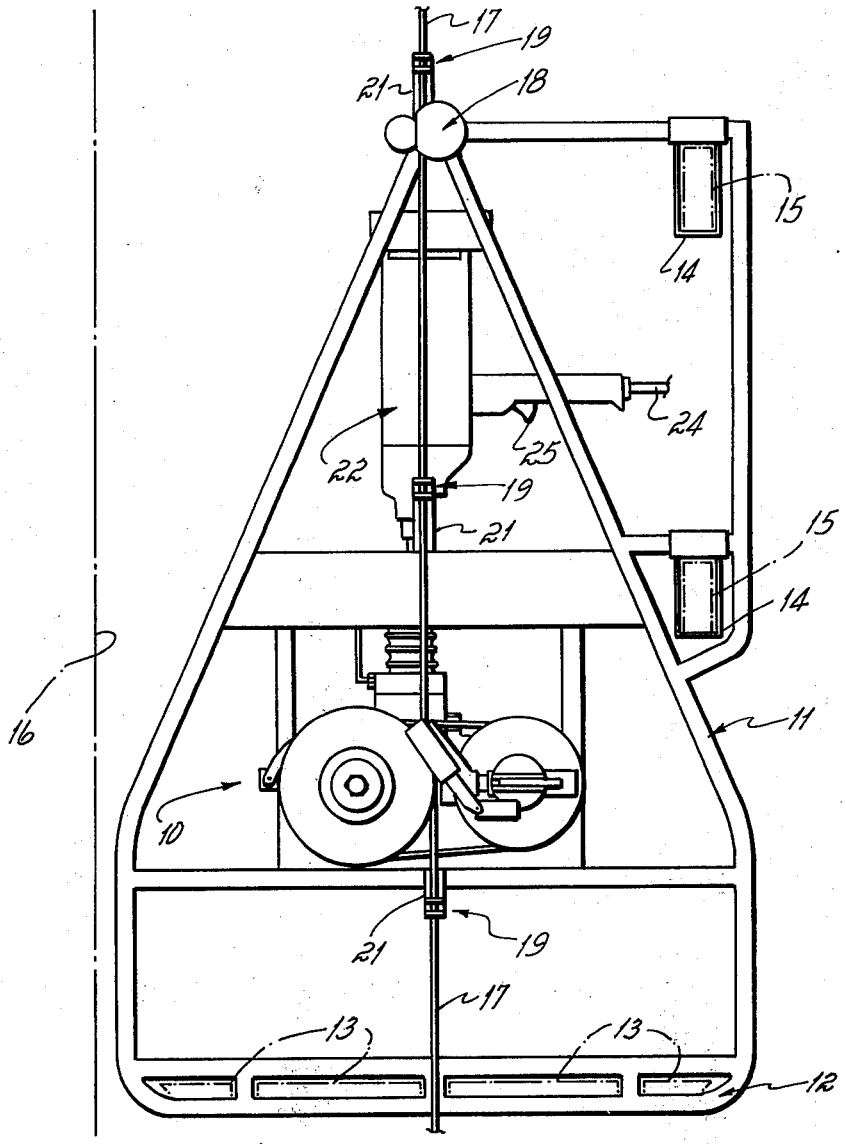
FIG. 1 is a general side elevational view schematically depicting a swing stage scaffold's hoisting mechanism in combination with the cable guide block of this invention.

Referring to the drawings, in the general side elevational view of FIG. 1 there is shown a hoisting mechanism 10 (that is, a power driven sheave system) mounted on an A-shaped stirrup or frame 11, such is particularly adapted for use with a swing stage scaffold. Under normal use conditions with a swing stage scaffold, two such hoisting mechanism 10-stirrup 11 structures are used with one being located at each end of planks 13 for raising and lowering that scaffold relative to ground level. The A-shaped stirrup 11 includes a scaffold support member 12 on which one end of the plank scaffold 13 rests, and brackets 14 which receive back rest boards 15. The scaffold planks 13, of course, are for standing on by the workmen, and the back rest boards 15 are for preventing the workmen from falling backwards off the scaffold as they do the job required on the building face 16 or other work surface.

A freely hanging single strand of cable 17 provides vertical support to the hoisting mechanism 10, and to the stirrup 11, the cable being fixed to and extending from an overhead support (not shown). The cable 17 is threaded in operative engagement with the hoisting mechanism and extends from the top to the bottom of the stirrup, the mechanism 10 being adapted to climb up and down the cable so as to raise and lower the stirrup relative to ground level. A safety lock 18 (more fully described in Allenbaugh U.S. Pat. No. 2,931,466) for the cable 17 is mounted at the apex or top of the stirrup. Cable guides 19 (fixed to the stirrup 11 through brackets 21 welded or otherwise fixed to the stirrup 11) are located above the safety lock 18, between the safety lock and the hoisting mechanism 10, and below the hoisting mechanism, to assist in guiding the cable into and out of the safety lock and into and out of the hoisting mechanism (i.e., into and out of the power driven sheave system), as the mechanism ascends and descends the cable. These cable guides 19 are each formulated in accord with the principles of this invention.

The hoisting mechanism 10 (more particularly described in Mauldin U.S. Pat. No. 3,794,928) is operated by a power unit 22, e.g., a heavy duty drill, fixed to the stirrup 11. The power unit 22 is electrically energized through lead 24, the unit being operated by a finger trigger switch 15. A reversing switch (not shown) on the power unit 22 allows the sheave system or hoisting mechanism 10 to be driven clockwise or counterclockwise, thereby allowing the mechanism to be positively driven both in its ascent up the cable 17 and its descent down the cable. Therefore, it is by means of the hoisting mechanism 10 itself, as driven by the power unit 22, that the stirrup frame 11 (and, hence, the swing stage scaffold) ascends and descends the freely hanging cables 17.

Figure 2:
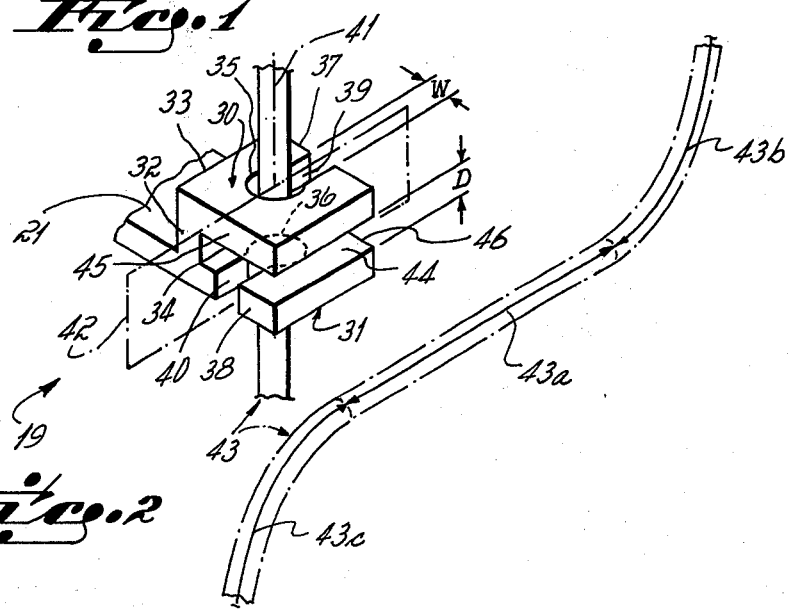
FIG. 2 is a perspective view illustrating in detail the cable guide block of this invention.

The specific cable guide block 19 of this invention is more particularly illustrated in FIG. 2. As shown in that Figure, the guide block 19 structure incorporates a top U-shaped hand plate 30 and a bottom U-shaped hand plate 31. The hand plates 30, 31 are planar in configuration, and are disposed parallel one to the other. The plates 30, 31 are interconnected together by a web 32 integral with both along corresponding continuous edges 33, 34 of the plates. The mounting bracket 21 is formed integral with the connecting web 32. The mounting bracket 21 may be provided with any suitable structure, e.g., bolt holes (not shown), for interconnecting the guide with, for example, the framework of the stirrup 11 or that other device with which the guide 19 is associated. Or the mounting bracket 21 may simply be welded to the framework of the stirrup 11.

Note particularly that each of the top 30 and bottom 31 hand plates is provided with a circular hole 35, 36 centrally located thereof. The hole 35, 36 in each plate 30, 31 communicates with respective edges 37, 38 of the plates by means of a slot 39, 40 formed to extend radially outward from its respective hole. The orientation of the plates relative one to the other is such that the centrally located holes 35, 36 are coaxial as denoted by common centerline 41, and such that the slots 39, 40 open to the environment in opposite directions one from the other (i.e., such that the slotted edges 37, 38 of the hand plates 30, 31 are disposed 180° relative one to the other and to the centerline 41). In this orientation, the slots 39, 40 are symmetrically disposed relative to a single vertical plane 42 that also incorporates the centerline 41 of the coaxially disposed holes 35, 36.

It is preferred that the plates be spaced one from the other a distance D only slightly greater than the diameter of the cable 43 to be used with the guide block 19. Further, it is preferred that the width W of each slot 39, 40 be identical one to the other, and that such width W be only slightly greater than the diameter of the cable 43 to be used with the guide block 19. In this connection, and if the cable used as a 5/16 inch cable, it is preferred that the distance D between the horizontally disposed plates be three-eighths inch, and that the width W of each slot also be three-eighths inch. It is further preferred that the diameter of each coaxial hole 39, 40 be equal one to the other, and that the diameter be substantially greater than the diameter of the cable 43 to be used with the guide block 19. In the instance of the 5/16 inch cable, it is preferred that the hole 39, 40 diameter for each plate be five-eighths inch. The larger hole 35, 36 diameter is desirable to prevent binding of the cable 43 in either or both the holes as it moves relative to the guide block 19, and also to prevent buckling of the cable between the hand plates 30, 31 (i.e., within the mouth 44 defined by the plates) due to binding in one hole and not in the other. Most preferably, each hole 35, 36 diameter should be at least about 1.6 times greater than the cable 43 diameter of the cable to be used with the guide. Also, and most preferably, the width W of slots 39, 40 and the distance D between the parallel hand plates 30, 31 should be not more than about 1.3 times the cable 43 diameter.

In use, and as is illustrated in FIG. 2, it will be apparent that a cable 43 can be operatively associated with the cable guide block 19 intermediate the ends of that cable, i.e., at any point along the length of the cable, thereby providing an open breach type of cable guide. As illustrated in FIG. 1, the cable guide blocks 19 shown in combination with the swing stage scaffold's stirrup 11 are fixed in place so that the centerline 41 of the holes 35, 36 are vertically disposed relative to the freely hanging cable strand that extends from an overhead support. When the cable guide block 19 is oriented with centerline 41 in vertical position, an intermediate section 43*a* of the cable is horizontally disposed relative to the section 43*b* that extends upwardly therefrom, and relative to section 43*c* which extends downwardly therefrom as shown in phantom lines in FIG. 2. This horizontally disposed section 43*a* is thereafter moved into the mouth 44 of the guide block (that mouth being defined by the upper 30 and lower 31 hand plates, and by the web 32 that connects those plates in fixed relation) along a line of travel substantially perpendicular to the vertical plane 42 within which the plates' slots 39, 40 lie. As the cable 43 is moved into the mouth 44, upper cable section 43*b* must move adjacent slotted edge 37 of the top plate 30 and lower cable section 43*c* must move adjacent slotted edge 38 of the bottom plate 31. The horizontally disposed section 43*a* of the cable 43 is so moved until same also lies in that plane 43 which incorporates the slots 39, 40 of the top 30 and bottom 31 hand plates, respectively. After reaching this attitude, the cable 43 is vertically oriented so that the same is substantially coaxially disposed relative to the two holes 39, 40 in the top 30 and bottom 31 hand plates, respectively, see solid line position in FIG. 2. In so moving the cable 43 from the FIG. 2 phantom line position, and as explained, it should be understood that the upper section 43*b* of the cable must be adjacent that edge 37 of the top hand plate 30 that incorporates that plate's slot 39, and the bottom section 43*c* of the cable must be adjacent that edge 38 of the bottom hand plate 31 that incorporates the bottom slot 40; if the top 43*b* and bottom 43*c* sections of the cables 43 were reversed, same would not fall into the holes 35, 36 in the respective hand plates when the cable reaches plane 42 because, of course, there are no slots in continuous edges 45, 46 in those plates which would permit access of the cable 43 into the holes 35, 36.

Figure 3:
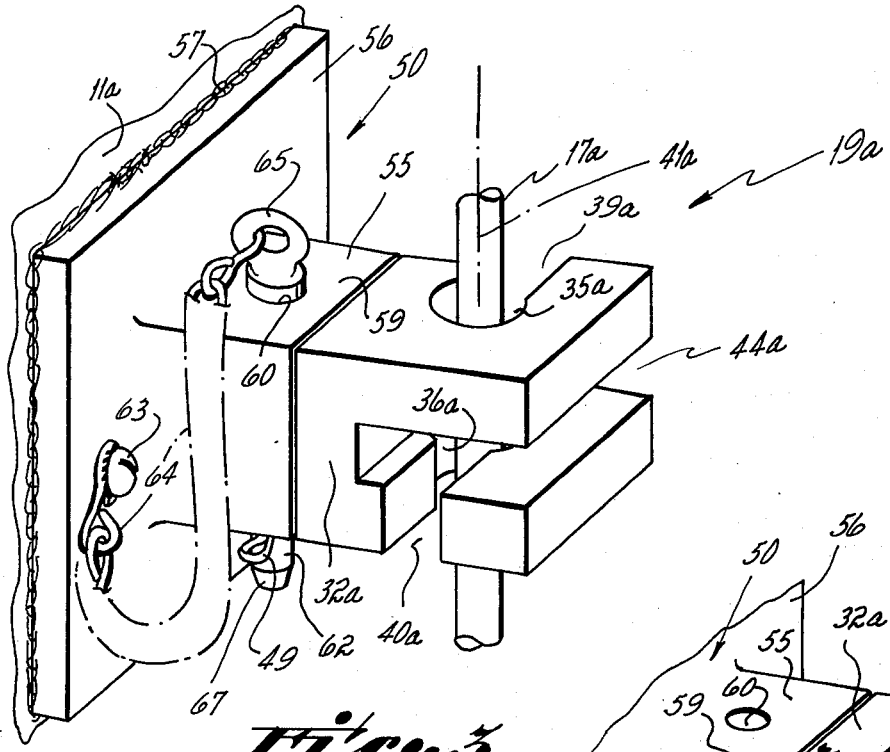
FIG. 3 is a perspective view illustrating in detail an alternative embodiment of the cable guide block of this invention, the guide block being shown in the cable-guiding position.
Figure 4:
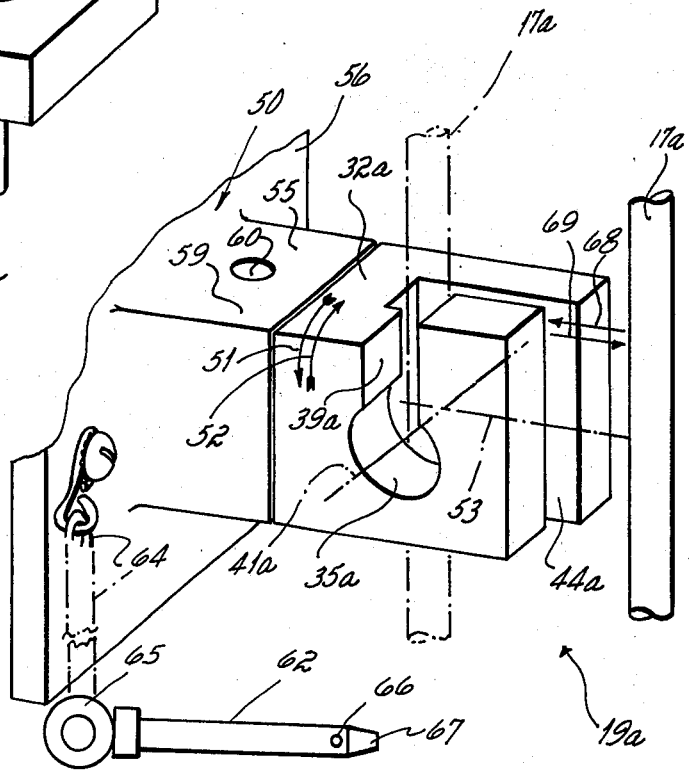
FIG. 4 is a perspective view similar to FIG. 3 illustrating the alternative embodiment in the cable-threading position.
Figure 5:
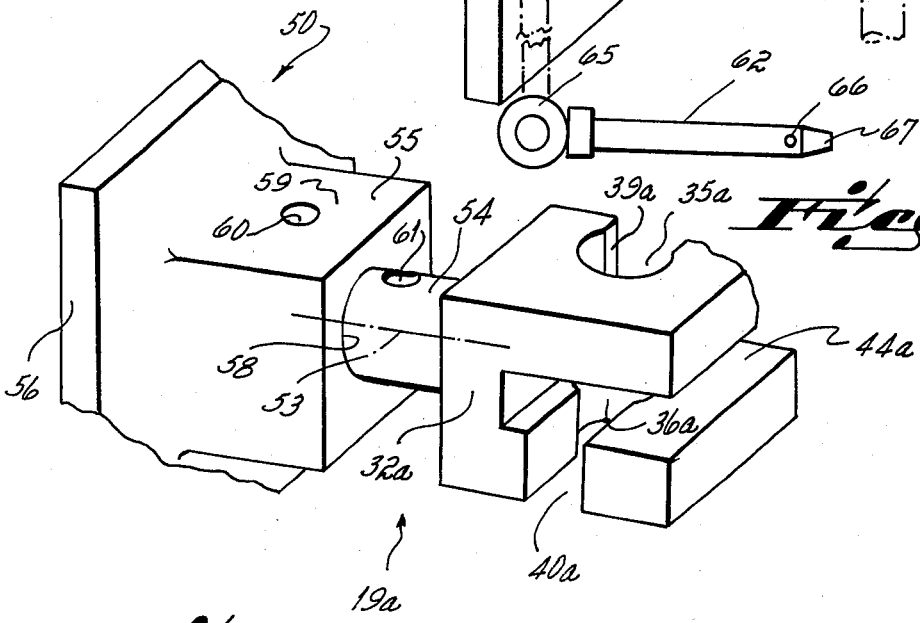
FIG. 5 is a broken away exploded view of the alternative embodiment illustrating the latch structure.

An alternative embodiment of the cable guide block of this invention is illustrated in FIGS. 3–5. The guide block structure illustrated in these FIGS. 3–5. is of the same open breach type as that shown in FIG. 2, but includes a mount bracket that permits same to be threaded with a cable while that cable is taut. As illustrated in FIG. 2 in connection with the basic embodiment of the cable block structure, the cable 43 must be slack at least on one end 43*c* thereof so as to permit temporary bending of the cable into that attitude illustrated in phantom lines in FIG. 2 during threading of the cable with the guide block 19. The alternative guide block embodiment 19*a* is identical to the embodiment 19 illustrated in FIG. 2 (and, hence, like parts are denoted with an *a* behind the reference numeral) except for the mount bracket 50 by which that guide block 19*a* is fixed to the framework of the stirrup 11*a*.

In the alternative embodiment of the guide block 19*a*, and as mentioned, same is fixed to the framework of the stirrup 11*a* by means of the mount bracket 50. The mount bracket permits the guide block 19*a* to be swivelled or pivoted between a cable-guiding position illustrated in FIG. 3 and a cable-threading position illustrated in FIG. 4 (see indicator arrows 51, 52 illustrating the pivot motion). This pivot motion occurs on pivot axis 53 that is transverse to the centerline 41*a* of coaxially positioned holes 35*a*, 36*a* of the guide block.

The structure that permits the pivotal motion of the guide block 19*a* includes a cylindrical post 54 fixed to and integral with the guide block's side wall or web 32*a*, that post 54 extending outwardly from the web 32*a* in a direction opposite to the opening of the guide block's mouth 44*a*, see particularly FIG. 5. Note that the cylindrical post 54 has an axis that is perpendicular or disposed at right angles relative to axis 41*a* of the holes 35*a*, 36*a*, this axis being the pivot axis 53 of the block 19*a*.

The guide block's cylindrical post 54 is adapted to be received in a seat 55 of the bracket 50 fixed to the framework of the stirrup 11*a*. The seat 55 is fixed to that stirrup 11*a* framework by suitable screws (not shown), or by welding the base plate 56 of that seat 55 onto the framework 11*a* as at 57, or otherwise as desired. The seat 55 is provided with a female type receptacle in the nature of a cylindrical hole or well 58 having an axis disposed perpendicular to the plane of the stirrup 11*a*. One side wall 59 of the seat 55 is provided with a pin hole 60 that extends into the well 58, that pin hole 60 being adapted to mate with a pin hole 61 provided in the guide block's post 54.

A latch pin 62 is permanently attached to the seat's base plate 56 by screw 63 and chain 64, operational freedom being provided to that pin by chain 64. The pin 62, of course, is connected to the chain at one end 65 and, the chain is fastened to the base plate by the screw 63 at the other end. The pin 62, as illustrated in FIG. 3, is engageable with the seat 55 and guide block's post 54 (when the guide block's post is operationally positioned in the cable-guiding attitude) to retain the guide block in the cable-guiding attitude. A cotter pin 49 may be inserted into cotter pin hole 66 at the free end 67 of the pin to insure that the latch pin is held in proper latching position during use of the guide block 19*a*, see FIG. 3. Thus, the pin 62 holds the guide block 19*a* in assembly with the mount bracket's seat 55, and prevents the guide block from rotating relative to that seat.

In use, and when it is desired to insert or thread a taut cable 17*a* into the guide block structure, the latch pin 62 is first removed and the guide block swivelled or pivoted in the direction of arrow 51 to the cable-threading position illustrated in FIG. 4 where the axis 41*a* of the holes 35*a*, 36*a* is perpendicular to the operational position of the cable. The cable 17*a* is then moved into alignment with slots 39*a*, 40*a* through mouth 44*a* of the guide block in the direction of arrow 68 as shown in FIG. 4. Subsequently the guide block 19*a* is pivoted in the direction of arrow 52 into the cable-guiding position illustrated in FIG. 3, thereby trapping the cable 17*a* within the guide block as shown in phantom lines in FIG. 3. In the cable-guiding position, of course, the latch pin 62 is inserted through the mount bracket's seat 55 and the guide block's post 54 to retain the guide block 19*a* in operational relation to the cable, thereby locating the cable in final guiding relation with the guide block. Removal of a taut cable 17*a* from the guide block 19*a* is, of course, accomplished by simply reversing the step previously outlined, the cable being withdrawn from the guide block through mouth 44*a* in the direction of arrow 69 after the guide block has been swivelled to the FIG. 4 position.

Having described in detail the preferred structure of my invention, what I desire to claim and protect by Letters Patent is:

1. A guide block for a cable, said guide block being of the open breach type comprising two U-shaped hand plates fixed in position relative one to the other, said plates being separated one from the other a distance at least slightly greater than the diameter of that cable to be guided therethrough, each hand plate being structured to provide a hole therethrough and a slot extending from that hole to one edge of said plate, each hole diameter being at least about 1.6 times greater than the cable diameter, and each slot width being not more than about 1.3 times the cable diameter, each hand plate being oriented relative to the other so that said holes are concentrically disposed and such that said slots face in opposite directions one from the other, and said hand plates being fixed relative one to the other so as to define a mouth to provide access to said slots for said cable intermediate the ends of said cable.

2. A guide block structure as set forth in claim 1 wherein said hand plates are disposed parallel one to the other, the distance between said parallel hand plates being not more than about 1.3 times the cable diameter.

3. A guide block for a cable, said guide block being of the open breach type comprising two U-shaped hand plates fixed in position relative one to the other, said plates being separated one from the other a distance at least slightly greater than the diameter of that cable to be guided therethrough, each hand plate being structured to provide a hole therethrough and a slot extending from that hole to one edge of said plate, each hand plate being oriented relative to the other so that said holes are concentrically disposed and such that said slots face in opposite directions one from the other, and said hand plates being fixed relative one to the other so as to define a mouth to provide access to said slots for said cable intermediate the ends of said cable, and a mount bracket connected with said guide block by which said guide block is fixed in place, said mount bracket permitting said guide block to be pivoted through an arc of at least about 90° on a pivot axis substantially perpendicular to the common axis of said holes.

4. A guide block structure as set forth in claim 3 wherein said mount bracket includes a post fixed to said guide block, a seat adapted to be fixed in place, said post being received in said seat, and a latch pin interconnectable with said seat and said post to retain said guide block in the desired cable-guiding position.

5. A guide block structure as set forth in claim 3 wherein each hole diameter is at least about 1.6 times greater than the cable diameter, and wherein each slot width is not more than about 1.3 times the cable diameter.

6. A guide block structure as set forth in claim 3 wherein said hand plates are disposed parallel one to the other, the distance between said parallel hand plates being not more than about 1.3 times the cable diameter.

* * * * *